US007018474B2

(12) United States Patent
Mandai et al.

(10) Patent No.: US 7,018,474 B2
(45) **Date of Patent: *Mar. 28, 2006**

(54) COATING APPARATUS

(75) Inventors: Toshihiro Mandai, Odawara (JP); Mikio Tomaru, Odawara (JP); Norio Shibata, Odawara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/367,718

(22) Filed: Feb. 19, 2003

(65) Prior Publication Data

US 2003/0154918 A1 Aug. 21, 2003

(30) Foreign Application Priority Data

Feb. 19, 2002 (JP) ..... 2002-041010

(51) Int. Cl.
*B05C 3/12* (2006.01)

(52) U.S. Cl. ..... 118/419; 118/410; 118/50

(58) Field of Classification Search ..... 118/410, 118/411, 412, 419, 602, 603, 50; 427/356
See application file for complete search history.

(56) References Cited

U.S. PATENT DOCUMENTS

| | | | | |
|---|---|---|---|---|
| 4,102,299 | A * | 7/1978 | Wallsten | 118/50 |
| 4,944,808 | A * | 7/1990 | Sugiyama et al. | 134/15 |
| 4,984,533 | A * | 1/1991 | Takahashi et al. | 118/415 |
| 6,582,768 | B1 * | 6/2003 | Mandai et al. | 427/356 |
| 2003/0099769 | A1 * | 5/2003 | Mandai et al. | 427/128 |
| 2003/0157251 | A1 * | 8/2003 | Mandai et al. | 427/350 |

FOREIGN PATENT DOCUMENTS

| | | | |
|---|---|---|---|
| JP | 58-109162 | A | 6/1983 |
| JP | 7-287843 | A | 10/1995 |

* cited by examiner

*Primary Examiner*—Brenda A. Lamb
(74) *Attorney, Agent, or Firm*—Sughrue Mion, PLLC

(57) ABSTRACT

In coating with two slits of a coating slit and a recovering slit, by optimizing the slit clearance of the coating slit and the recovering slit, a coating layer with a very small and even thickness can be obtained. In a coating apparatus in which after a coating liquid is applied to a web to excess through the coating slit, a desired amount of coating liquid is applied to the web by scraping off an excess of coating liquid with a recovering slit, there is provided a slit clearance adjusting device for adjusting the slit clearance of the recovering slit.

3 Claims, 8 Drawing Sheets

FIG.8 ( a )
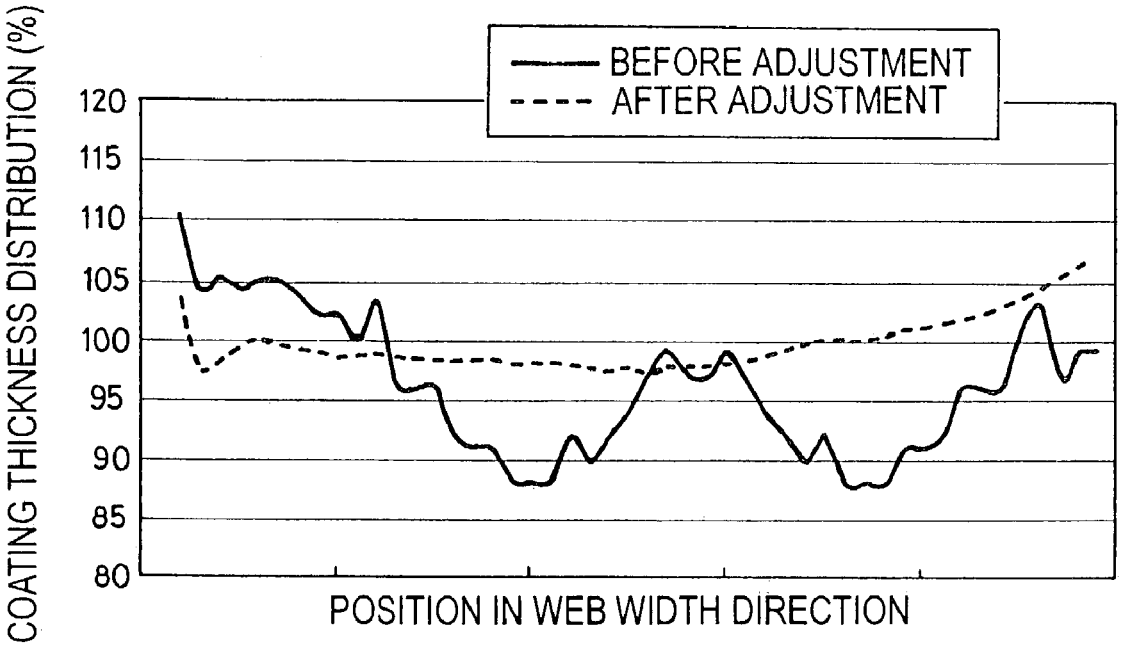
FIG.8 ( b )
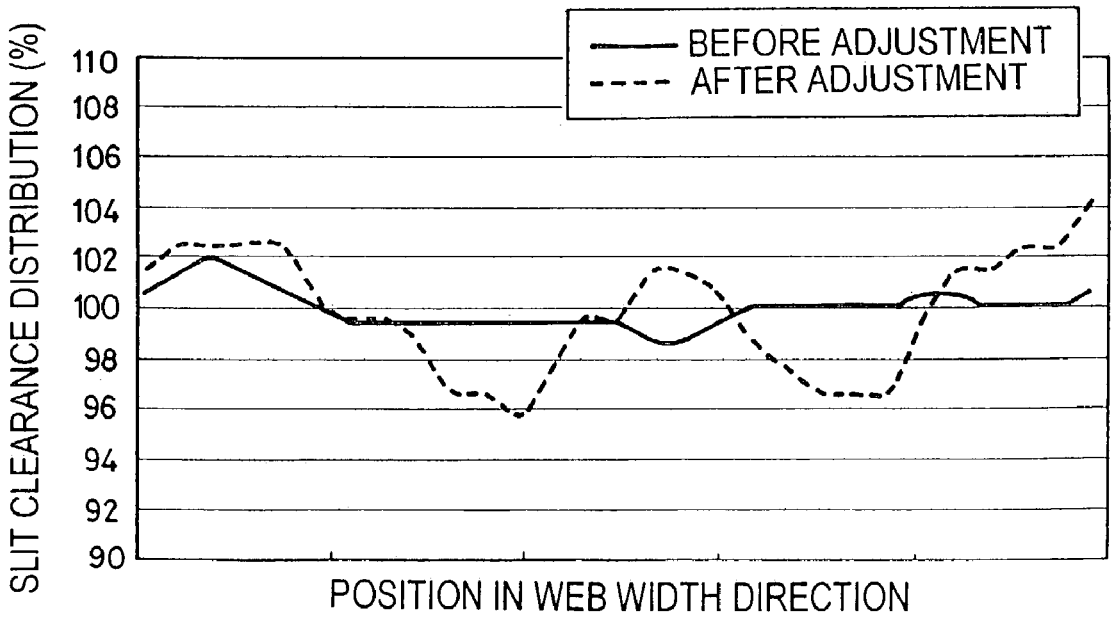

COATING APPARATUS

BACKGROUND OF THE INVENTION

1. Field of the Invention

The present invention relates to a coating apparatus and, more particularly, to an improvement in extrusion type coating apparatus that is used for manufacturing photosensitive materials and magnetic recording media.

2. Description of the Related Art

Photosensitive materials and magnetic recording media are manufactured through a coating step of forming a coating film by applying a coating liquid, such as a magnetic liquid, to a continuously running substrate sheet (hereinafter referred to as "web"). In recent years, magnetic recording media such as magnetic recording tapes particularly for broadcasting and computer use have been rapidly improved in capacity and recording density, and there has been needed a coating technology capable of providing a magnetic layer which has an extremely thin film thickness and a smooth surface.

Coating apparatuses for applying a coating liquid to the surface of a web include, for example, apparatuses of types such as roll coater, gravure coating, roll coating plus doctor roll, extrusion coating, and slide coating. In recent years, an apparatus of extrusion type has been commonly used to apply a magnetic coating liquid.

One method employing an extrusion type coating apparatus in which the tip of a coating head is pushed against a web, as described in Japanese Patent Application Publication No. 58-109162, has been commonly used in the field of manufacturing magnetic recording media because a thin and uniform coating layer can be obtained by increasing the liquid pressure at the tip of the coating head utilizing the web tension, thereby eliminating the air accompanying the web. However, even in the method of applying a single coat of liquid using this type of coating head, the reduction in coating thickness is limited.

As a method for forming a much thinner coating layer, there is a method in which a very thin coating layer can be formed by applying an excess amount of coating liquid to a web using a web-pushing type extrusion coating apparatus and then scraping off the excess coating liquid with a blade disposed on the downstream side of the extrusion coating apparatus, as described in Japanese Patent Application Publication No. 7-287843. In this case, a device which applies an excess amount of coating liquid to a web is not necessarily limited to the web-pushing type extrusion coating apparatus, but coating apparatuses such as roller coater, gravure coater, and extrusion coater equipped with a back-up roll can be used.

In the scraping-off type coating apparatus as disclosed in Japanese Patent Application Publication No. 7-287843, however, since the coating liquid recovered by being scraped off with the blade has once been exposed to the atmosphere in a process from the coating apparatus to the blade, the solvent contained in the coating liquid volatilizes, whereby the liquid physical properties such as viscosity and solid content concentration are changed. Thus, the apparatus has a disadvantage in that the recovered liquid must undergo treatment for adjusting its physical properties such as viscosity and solid content concentration before being reused. Further, the apparatus has a disadvantage in that dust is liable to be included in the coating liquid having been applied to the web because the recovered liquid comes once into contact with the atmosphere, so that the recovered liquid cannot be reused because dust cannot be removed even if an excess liquid recovered with the blade is filtered.

With such a background, the present inventors have proposed coating method and apparatus in Japanese Patent Application Nos. 2001-302401 and 2001-302402 corresponding to U.S. patent application Ser. No. 10/253,427 and German Patent Application No. 102 44 882.5 such that two slits of a coating slit and a recovering slit are provided so that an excess of coating liquid that has been discharged excessively from the coating slit and applied to a web is scraped off with the recovering slit or an excess of coating liquid is sucked up into the recovering slit. According to the coating method and apparatus, the recovered coating liquid can be reused without any one of liquid-adjusting treatment and filtering treatment.

However, the coating apparatus having two slits of the coating slit and recovering slit is a novel coating apparatus exceeding the limit of conventional idea. The optimization of slit clearance of the coating slit and recovering slit is of importance in obtaining a coating layer with a very small and even thickness.

SUMMARY OF THE INVENTION

The present invention has been made in view of the above situation, and an object thereof is to provide a coating apparatus in which in coating with two slits of a coating slit and a recovering slit, the slit clearance of the coating slit and recovering slit is optimized so that a coating layer with a very small and even thickness can be obtained.

To attain the above object, the present invention is directed to a coating apparatus in which in a state where a continuously running web is brought close to a lip surface at a tip of a coating head, a coating liquid sent into the coating head in excess of a desired amount is discharged through a coating slit and is applied to the web, and an excess of coating liquid applied to excess is scraped off with a recovering slit provided on a downstream side of the coating slit in a running direction of the web, wherein: there is provided a slit clearance adjusting device which adjusts a width of at least one of the coating slit and the recovering slit.

According to the present invention, in the coating apparatus in which after the coating liquid is applied to excess through the coating slit, an excess of coating liquid is scraped off with the recovering slit to apply the desired amount of coating liquid to the web, there is provided a slit clearance adjusting device which adjusts the clearance of at least one of the coating slit and the recovering slit. Thus, by changing the clearance of at least one of the coating slit and the recovering slit, the amount of coating liquid applied through the coating slit or the amount of coating liquid scraped off with the recovering slit can be adjusted. Therefore, the thickness of coating layer formed finally to the web can be adjusted with high accuracy. Also, by adjusting the slit clearance in the web width direction of at least one of the coating slit and the recovering slit by using the slit clearance adjusting device, the distribution of coating amount and scraping-off amount in the web width direction can be adjusted. Thereby, a coating layer with a very small and even thickness can be obtained.

To attain the above object, the present invention is also directed to a coating apparatus in which in a state where a continuously running web is brought close to a lip surface at a tip of a coating head, a coating liquid sent into the coating head in excess of a desired amount is discharged through a coating slit and is applied to the web, and an excess of coating liquid applied to excess is sucked up with a sucking-up device through a recovering slit provided on a downstream side of the coating slit in a running direction of the web, wherein: there is provided a slit clearance adjusting device which adjusts a width of at least one of the coating slit and the recovering slit.

According to the present invention, in the coating apparatus in which after the coating liquid is applied to excess through the coating slit, an excess of coating liquid is sucked up with the sucking-up device through the recovering silt to apply the desired amount of coating liquid to the web, there is provided a slit clearance adjusting device which adjusts the clearance of at least one of the coating slit and the recovering slit. Thus, by changing the clearance of at least one of the coating slit and the recovering slit, the amount of coating liquid applied through the coating slit or the amount of coating liquid sucked up through the recovering slit can be adjusted. Therefore, the thickness of coating layer formed finally to the web can be adjusted with high accuracy. Also, by adjusting the slit clearance in the web width direction of at least one of the coating slit and the recovering slit by using the slit clearance adjusting device, the distribution of coating amount and sucking-up amount in the web width direction can be adjusted. Thereby, a coating layer with a very small and even thickness can be obtained.

As a preferred mode of the present invention, it is preferable that two or more slit clearance adjusting devices be arranged in the web width direction of the slit.

The coating slit and the recovering slit may be formed in the same coating head. Alternatively, the configuration may be such that the coating head is formed with the coating slit only, and the recovering head formed with the recovering slit is provided separately to integrally arrange the coating head and the recovering head. Also, as a web used in the present invention, a web in which an undercoat is applied and solidified in advance may be used.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIGS. 8(*a*) and 8(*b*) are graphs showing coat thickness distribution and clearance distribution in the web width direction before and after a recovering slit is adjusted by a slit clearance adjusting device.

DETAILED DESCRIPTION OF THE PREFERRED EMBODIMENTS

Preferred embodiments of a coating apparatus in accordance with the present invention will now be described in detail with reference to the accompanying drawings.

Figure 1:
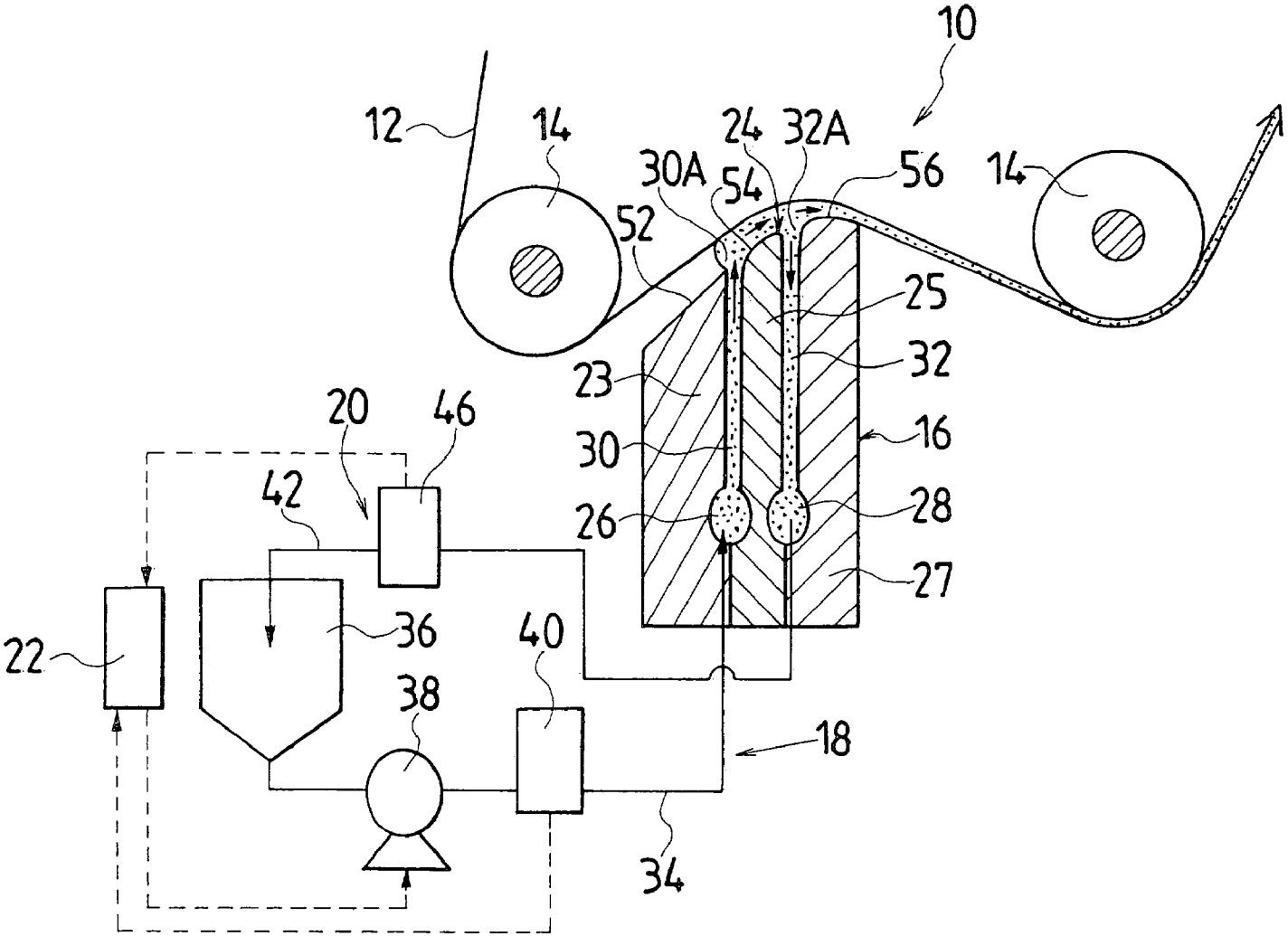
FIG. 1 is a schematic view for illustrating a general construction of a scraping-off type coating apparatus of coating apparatuses in accordance with the present invention.
Figure 2:
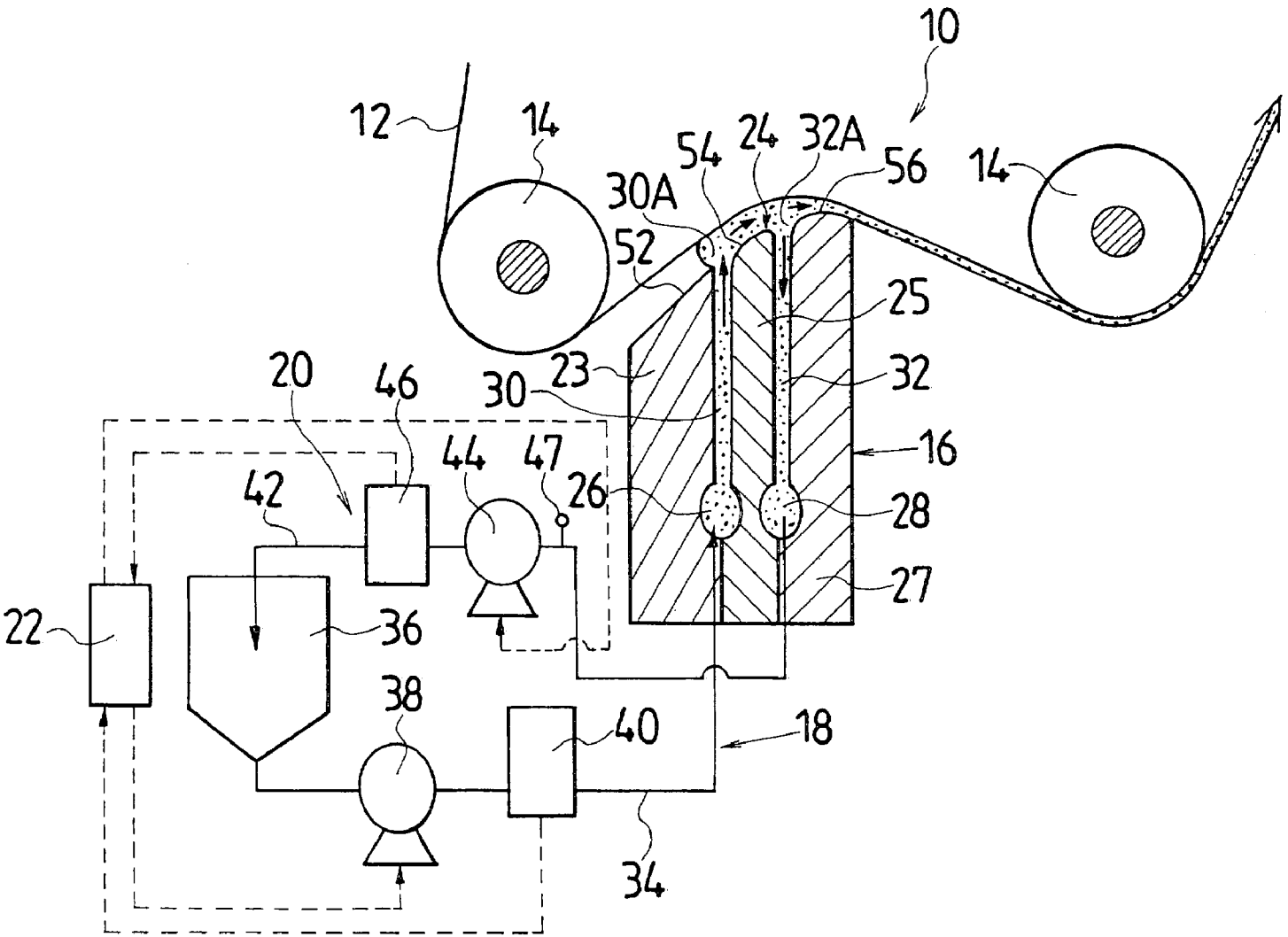
FIG. 2 is a schematic view for illustrating a general construction of a sucking-up type coating apparatus of coating apparatuses in accordance with the present invention.

FIG. 1 is a schematic view for illustrating a general construction of a coating apparatus of a type such that an excess of coating liquid is scraped off with a recovering slit (hereinafter referred to as "scraping-off type coating apparatus"), which is a first embodiment of the present invention. FIG. 2 is a schematic view for illustrating a general construction of a coating apparatus of a type such that an excess of coating liquid is sucked up with a suction pump through the recovering slit (hereinafter referred to as "sucking-up type coating apparatus"), which is a second embodiment of the present invention. In explaining the coating apparatuses of the first and second embodiments, when "scraping-off type" and "sucking-up type" are not especially specified, the construction is regarded as common one, and explanation is given by applying the same reference numerals. Also, in these embodiments, explanation is given by taking an example in which an extrusion type coating head shown in FIG. 3 is provided with two slits of a coating slit and a recovering slit.

As shown in FIG. 1, a coating apparatus 10 comprises support rollers 14 for guiding a running web 12, a coating head 16 having two slits 30 and 32 for coating and recovering, a slit clearance adjusting device 15 (see FIGS. 5 to 7) for adjusting the clearance of at least one of the coating slit 30 and the recovering slit 32, a supplying line 18 for supplying a coating liquid to the coating head 16 in an amount in excess of the amount required for coating the web 12, a recovering line 20 for recovering an excess of coating liquid, and a controller 22 for controlling the supplying line 18 and the recovering line 20. The coating head 16 is arranged in such a manner as to face the continuously running web 12 with its lip surface 24 at the tip thereof being close to the web 12.

Figure 3:
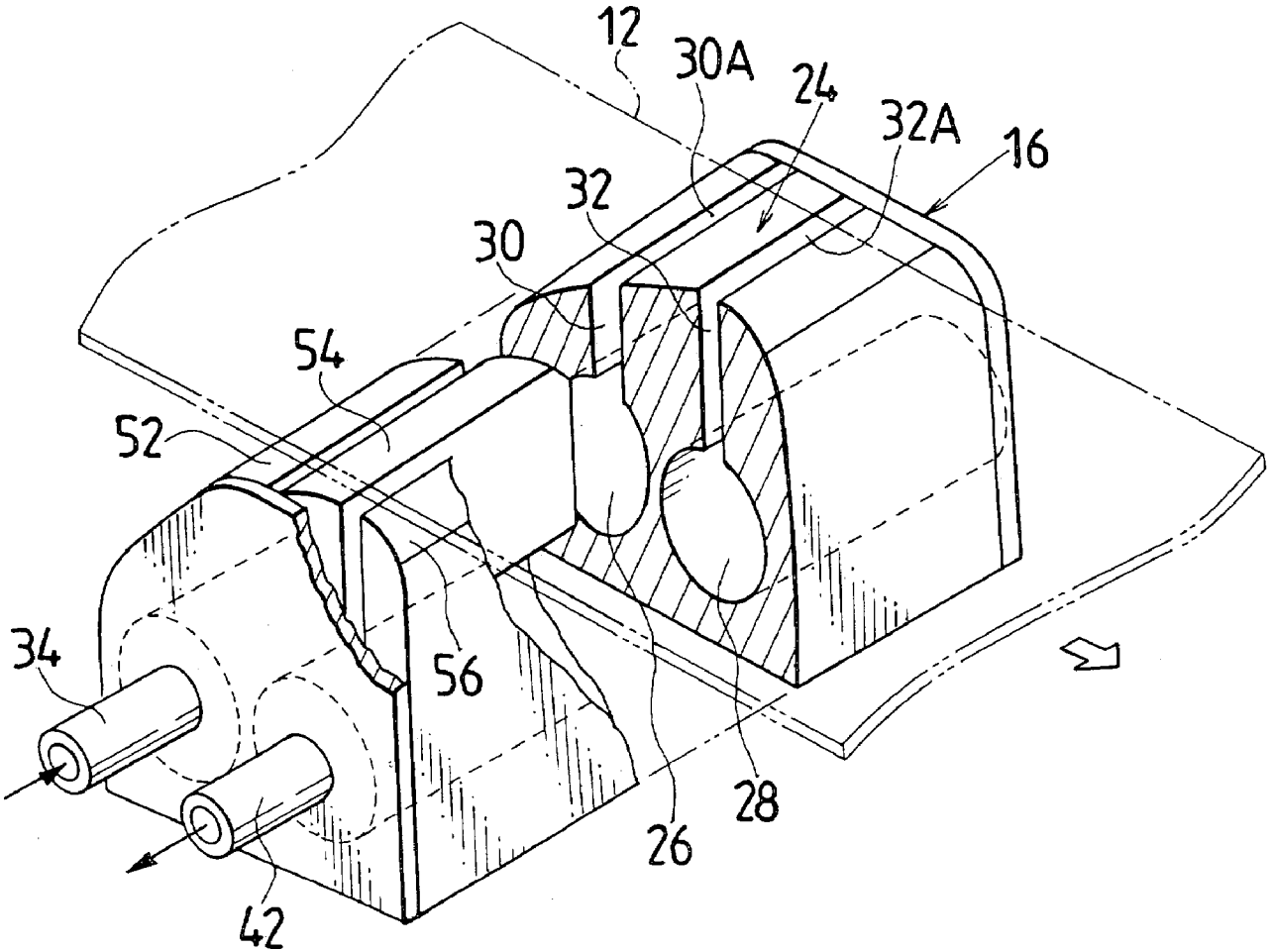
FIG. 3 is a partially sectional view for illustrating a construction of a coating head.

As shown in FIGS. 1 to 3, within the coating head 16, a pair of cylindrical pocket portions 26, 28 including a coating pocket portion 26 and a recovering pocket portion 28, are formed in parallel with each other in the web width direction. The coating pocket portion 26 is connected to the supplying line 18, and the recovering pocket portion 28 is connected to the recovering line 20. Within the coating head 16, a coating slit 30 having a discharge port 30A in the lip surface 24 and a recovering slit 32 having a recovering port 32A in the lip surface 24 on the downstream side relative to the discharge port 30A as viewed along the running direction of the web 12 are also formed. The coating slit 30 and the recovering slit 32 are in communication with the coating pocket portion 26 and the recovering pocket portion 28, respectively. The coating slit 30 and the recovering slit 32 are narrow pathways connecting the respective pocket portions 26, 28 and the lip surface 24 and are extended in the widthwise direction of the web 12. A coating liquid is supplied from the supplying line 18 to the coating pocket portion 26 in an amount in excess of the desired amount to be applied to the web 12, and the excess amount of coating liquid having been recovered through the recovering slit 32 into the recovering pocket portion 28 is discharged into the recovering line 20. While one type of coating head is illustrated in FIG. 3 in which, as a method for pumping a coating liquid into the coating pocket portion 26, the coating liquid is supplied from one side of the coating pocket portion 26, there are other types in which a coating liquid is supplied from one side of the coating pocket portion 26 and drawn from the other side, or in which a coating liquid is supplied from a middle portion of the coating pocket portion 26 and branched into both sides. Any of these types of coating heads can be applied. Also, although a coating liquid is recovered from one side of the recovering pocket portion 28 in this embodiment, the coating liquid may be recovered from a middle portion of the recovering pocket portion 28.

The coating head 16 is constructed by combining three blocks 23, 25 and 27, and the pocket portions 26, 28 and the slits 30, 32 are formed by assembling the blocks 23, 25 and 27. The pocket portions 26, 28 must be formed so as to have a cross-sectional shape which prevents stagnation of coating liquid. The cross-sectional shape thereof should preferably be circular. The slits 30, 32 are generally parallel with each other in the range from the pocket portion 26, 28 to the discharge port 30A or the recovering port 32A. However, the slits 30, 32 may be formed so that the distance therebetween decreases or increases toward the discharge port 30A or the recovering port 32A. The slit clearance of the slit 30, 32 is preferably set in the range of 0.05 to 2 mm at the position of the discharge port 30A or the recovering port 32A. The coating slit 30 further preferably has a slit clearance in the range of 0.1 to 0.3 mm, and the recovering slit 32 in the range of 0.2 to 2 mm.

Figure 4:
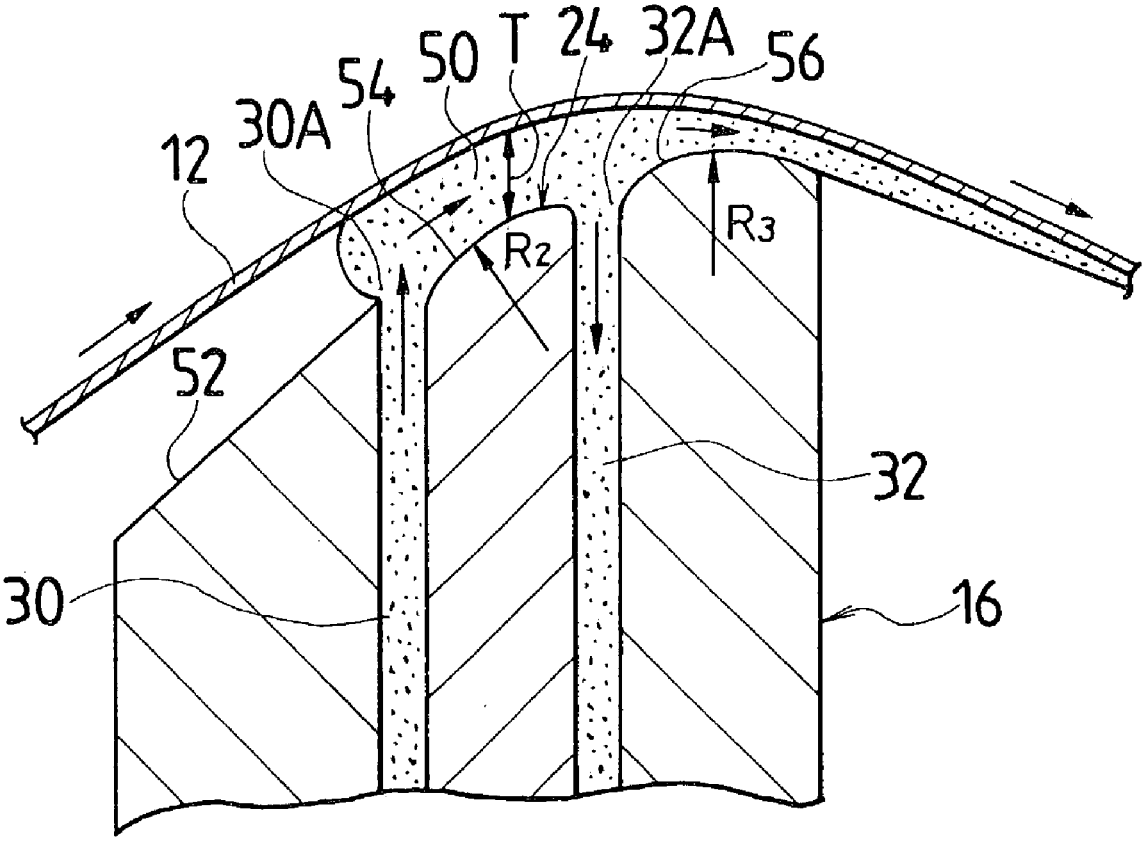
FIG. 4 is a sectional view for illustrating a lip surface of a coating head.

The lip surface 24 of the coating head 16 preferably uses an ultrahard material with Rockwell hardness of HRA85 such as cemented carbide and ceramics to increase the working accuracy and to restrain abrasion at the time of long-term use. Regarding the shape of the lip surface 24, as shown in FIG. 4, in the case of the scraping-off type, of a back lip surface 52, a doctor lip surface 54, and a recovering lip surface 56, the doctor lip surface 54 and the recovering lip surface 56 each have an arcuate curved surface, and the relation of $R_2>R_3$ preferably holds, where $R_2$ represents the radius of curvature of the doctor lip surface 54 and $R_3$ the radius of curvature of the recovering lip surface 56. This makes the pressure occurring on the recovering lip surface 56 higher than that occurring on the doctor lip surface 54, thereby allowing the coating liquid to be scraped off more easily in the recovering slit 32. On the other hand, in the case of sucking-up type, the doctor lip surface 54 and the recovering lip surface 56 preferably each have an arcuate curved surface with a proper radius of curvature to smoothen the coating liquid, and the radiuses of curvature $R_2$ and $R_3$ in FIG. 4 are preferably in the range of 0.5 to 20 mm.

Figure 5:
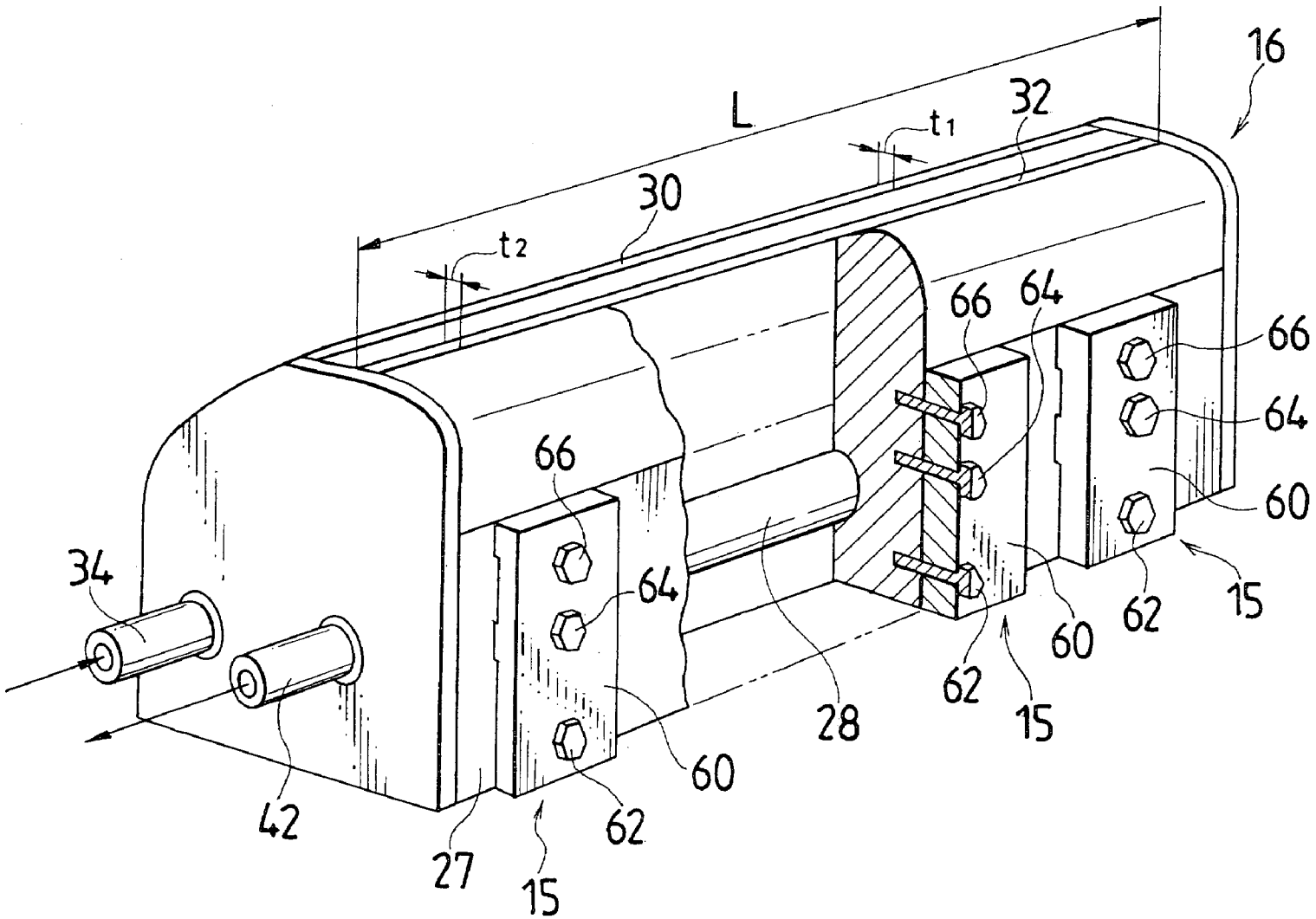
FIG. 5 is a partially cutaway perspective view for illustrating a construction of a slit clearance adjusting device.
Figure 6:
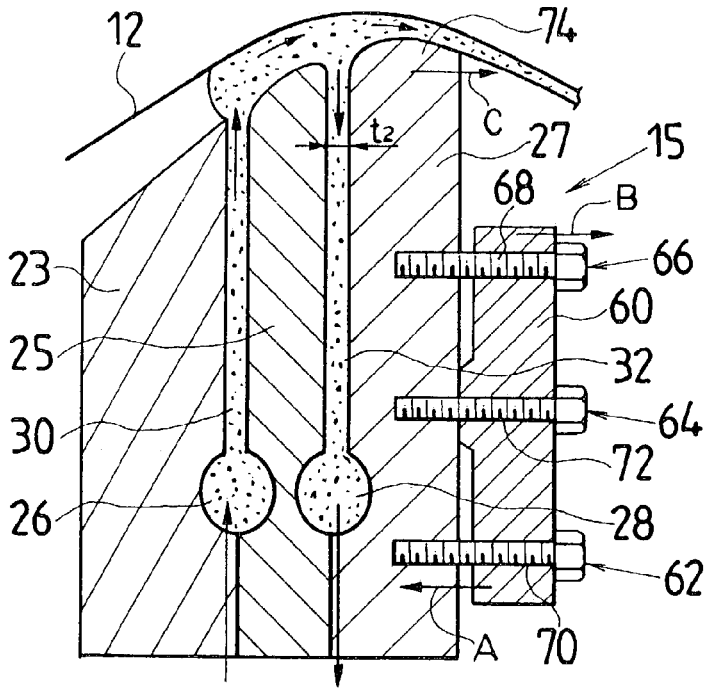
FIG. 6 is a side sectional view for illustrating a slit clearance adjusting device for adjusting the clearance of a recovering slit.
Figure 7:
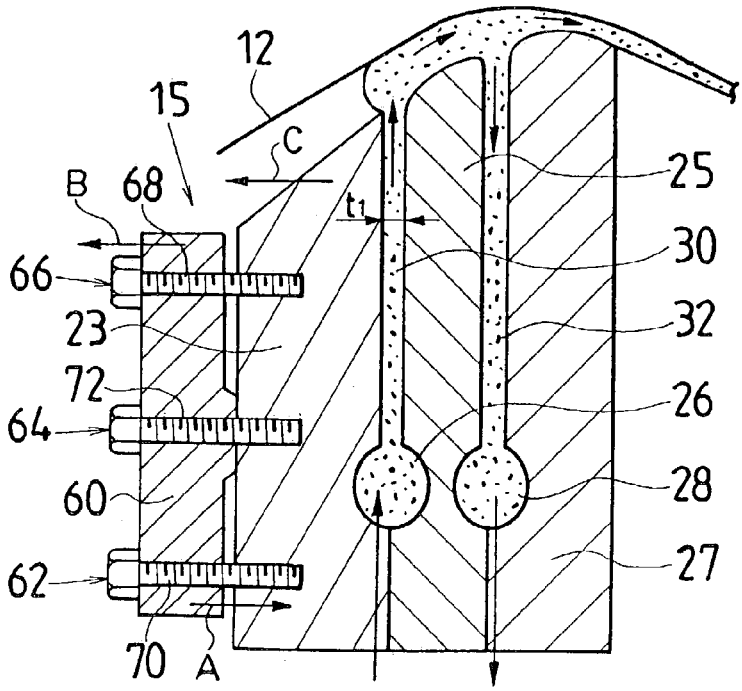
FIG. 7 is a side sectional view for illustrating a slit clearance adjusting device for adjusting the clearance of a coating slit.

FIGS. 5 to 7 are views for illustrating the slit clearance adjusting device 15. FIGS. 5 and 6 shows a case where the slit clearance adjusting device 15 is used to adjust the slit clearance of the recovering slit 32, and FIG. 7 shows a case where the slit clearance adjusting device 15 is used to adjust the slit clearance of the coating slit 30. Since the slit clearance adjustment is the same for the coating slit 30 and the recovering slit 32, explanation is given concerning the slit clearance adjustment of the recovering slit 32.

The slit clearance adjusting device 15 comprises a yoke 60, an urging screw 62 installed in the yoke 62, a supporting point screw 64, and a fixing screw 66. As shown in FIG. 6, the yoke 60 is installed so as to project from the outside wall surface of the block 27 of the three blocks constituting the coating head 16, and is fixed to the block 27 with the fixing screw 66 in an operating portion 68 closest to the lip surface 24 of the coating head 16. An urging portion 70 farthest from the lip surface 24 is provided with the urging screw 62, and a supporting point portion 72 at a middle position between the operating portion 68 and the urging portion 70 is supported by the supporting point screw 64. The screwing-in amount of the urging screw 62 relative to the outside wall surface of the block 27 is adjusted to apply a force to the operating portion 68, by which a slit clearance $t_2$ of the recovering slit 30 is adjusted. For example, when the screwing-in amount of the urging screw 62 is adjusted so that the urging portion 70 comes close to the outside wall surface of the block 27 (in the direction of arrow A), the principles of the lever and fulcrum act with the supporting point portion 72 being a fulcrum, so that a force in the direction of arrow B is applied to the operating portion 68. Thereby, of the blocks 23, 25 and 27 separably constituting the coating head 16, a portion close to the tip of the block 27 to which the yoke 60 is installed is pulled in the direction of arrow B, and accordingly a tip end portion 74 of the coating head 16 moves in the direction corresponding to the direction of arrow B (in the direction of arrow C). As a result, the slit clearance $t_2$ of the recovering slit 32 is widened. Therefore, by individually adjusting three slit clearance adjusting devices 15 provided in both end portions, right and left, and a middle portion of the outside wall surface of the block 27, the slit clearance distribution in the slit clearance (L) direction (same as the web width direction) can be adjusted. Thereby, the slit clearance $t_2$ of the recovering slit 32 is changed, so that the amount of coating liquid scraped off with the recovering slit 32 can be adjusted, and also by adjusting the slit clearance in the web width direction, the distribution of scraping-off amount in the web width direction can be adjusted.

Although explanation has been given by taking an example in which the slit clearance of the recovering slit 32 is adjusted as shown in FIGS. 5 and 6, when the slit clearance adjusting device 15 is provided on the outside wall surface of the block 23 of the coating head 16 as shown in FIG. 7, the adjustment of a slit clearance $t_1$, of the coating slit 30 and the adjustment of the coating amount distribution in the web width direction of the coating slit 30 can be made. Further, the slit clearance adjusting device 15 may provided on both of the outside wall surfaces of the blocks 23 and 27 so that the adjustment of the slit clearance $t_1$ of the coating slit 30, the adjustment of coating amount distribution in the web width distribution of the coating slit 30, the adjustment of the slit clearance $t_2$ of the recovering slit 32, and the adjustment of the scraping-off amount distribution in the web width direction of the recovering slit 32 can be made. Although three slit clearance adjusting devices are arranged in the web width direction in this embodiment, the number of the devices is not limited to three. The arrangement of two or more slit clearance adjusting devices is preferable.

The supplying line 18 is such that its supplying piping 34 connects a coating liquid tank 36 and the coating pocket portion 26 of the coating head 16 and in the middle of the supplying piping 34 are provided a supplying pump 38 for supplying a coating liquid to the coating pocket portion 26 and a supplying flowmeter 40 for measuring the amount of coating liquid flowing through the supplying piping 34 as shown in FIGS. 1 and 2. The rotational speed of a driving motor (not shown) for the supplying pump 38 can be controlled, and the flow rate is adjusted by controlling the rotational speed of the driving motor.

The recovering line 20 in the case of the scraping-off type shown in FIG. 1 is such that its recovering piping 42 connects the recovering pocket portion 28 and the coating liquid tank 36 and in the middle of the recovering piping 42 is provided a recovering flowmeter 46 for measuring the amount of coating liquid flowing through the recovering piping 42.

On the other hand, in the case of the sucking-up type shown in FIG. 2, a suction pump 44 for sucking up an excess of coating liquid into the recovering slit 32 is provided in the recovering piping 42 between the recovering pocket portion 28 and the recovering flowmeter 46 shown in FIG. 1. The rotational speed of a driving motor (not shown) for the suction pump 44 can be controlled, and the flow rate is adjusted by controlling the rotational speed of the driving motor. Also, a pressure gage 47 for measuring a liquid pressure on the suction port side of the suction pipe 44 is provided.

As the supplying pump 38 and the suction pump 44, a metering gear pump is preferably used.

The support rollers 14 are provided as a pair on both of the upstream and downstream sides relative to the coating head 16 in the web running direction, and arranged at positions lower than the tip of the coating head 16 as shown in FIGS. 1 and 2. Thus, the continuously running web 12 is brought close to the lip surface 24 of the coating head 16 in such a manner as to be pushed against the same. In this case, it is preferable that by varying the web tension in the web running direction, the pushing force which pushes the web 12 against the lip surface 24 can be varied. Also, it is preferable that the support rollers 14 be constructed so as to be capable of coming close to and going away from the lip surface 24 so that an approaching angle at which the running web 12 approaches the lip surface 24 of the coating head 16 and a leaving angle at which the web 12 leaves the lip surface 24 can be adjusted.

Into the controller 22 are input the measured values of the amount of the coating liquid supplied and the amount of the coating liquid recovered, which are measured with the supplying flowmeter 40 and the recovering flowmeter 46, respectively. Further, in the controller 22, an operation is conducted to determine whether or not a difference between the amount of the coating liquid supplied $Q_1$ and the amount of the coating liquid recovered $Q_2$ agrees with the desired amount Q of the coating liquid applied to the web 12. If the difference does not agree with the desired amount, the controller 22 controls the rotational speed of the driving motor for the supplying pump 38 in the case of the scraping-off type shown in FIG. 1, and it controls at least one of the rotational speeds of the driving motors for the supplying pump 38 and the suction pump 44 in the case of the sucking-up type shown in FIG. 2 to make both amounts agree with each other.

In the case of the scraping-off type, the coating liquid having been applied to the web 12 to excess at the discharge port 30A of the coating slit 30 reaches the recovering port 32A of the recovering slit 32 while accompanying the web 12, and an excess of coating liquid is scraped off by an edge portion of recovering port 32A. Thus, the coating liquid applied to the web to excess is divided into two: coating liquid flowing through the recovering slit 32, and coating liquid decreased to the desired amount and successively accompanying the web 12. Therefore, by controlling the rotational speed of the driving motor for the supplying pump 38 by using the controller 22, the amount of the coating liquid accompanying the web 12 is adjusted so as to be the desired coating liquid amount Q. By decreasing the amount of the coating liquid accompanying the web 12, a very thin coating layer can be obtained.

In the case of the sucking-up type, by driving the supplying pump 38 and the suction pump 44, a circulation flow of coating liquid from the coating liquid tank 36 to the supplying piping 34 to the coating pocket portion 26 to the coating slit 30 to the recovering slit 32 to the recovering pocket portion 28 to the recovering piping 42 to the coating liquid tank 36 is formed. Since the amount of the coating liquid supplied by the supplying pump 38 is larger than the amount of the coating liquid recovered by the suction pump 44, the applied coating liquid is divided into coating liquid flowing through the recovering slit 32 and coating liquid flowing while accompanying the web 12 at the recovering port 32A. Therefore, by controlling at least one of the rotational speeds of the driving motors for the supplying pump 38 and the suction pump 44 by using the controller 22, the amount of the coating liquid accompanying the web 12 is adjusted so as to be the desired coating liquid amount Q. By decreasing the amount of the coating liquid accompanying the web 12, a very thin coating layer can be obtained.

In both cases of the scraping-off type and the sucked-up type, as shown in FIG. 4, a wet thickness T of the excess coating liquid between the web 12 and the doctor lip surface 54, of the back lip surface 52, the doctor lip surface 54, and the recovering lip surface 56 constituting the lip surface 24, that is, a wet thickness of the coating liquid before being sucked up with the recovering slit 32 is preferably 3 $cm^3/m^2$ or larger (indicated by the amount of coating liquid per square meter). The reason for this is that if the wet thickness T is too small, a liquid pressure enough to exclude air accompanying the web 12 is not produced, so that defects such as a score are liable to occur on the coating film surface finally obtained on the web 12.

The following is a description of the operation of the coating apparatus 10 constructed as described above.

The coating liquid pumped out in excess from the coating liquid tank 36 by the supplying pump 38, flowing through the supplying piping 34 and supplied to the coating pocket portion 26 of the coating head 16, rises up through the coating slit 30 and is discharged from the discharge port 30A. The coating liquid discharged to excess from the discharge port 30A is applied to the web 12 while forming beads 50 between the lip surface 24 of the coating head 16 and the web 12 running adjacently to the lip surface 24. In other words, the coating liquid supplied to excess is applied to the web 12 in such a state that a discharge force which discharges the coating liquid from the discharge port 30A and a pushing force of the web 12 against the lip surface 24 of the coating head 16 are well balanced. Meanwhile, at the recovering port 32A of the recovering slit 32 formed in the lip surface 24 on the downstream side relative to the discharge port 30A in the web running direction, an excess of coating liquid is recovered into the recovering slit 32 by scraping off or sucking up. Thereby, a coating layer is formed on the web 12.

In forming this coating layer, the slip clearance of at least one of the coating slit 30 and the recovering slit 32 is adjusted by the slip clearance adjusting device 15 according to the coating conditions such as coating speed, coating thickness, and kind and viscosity of coating liquid. In this case, the adjustment is preferably made considering the rotational speeds of the driving motors for the supplying pump 38 and the suction pump 44. For example, when the thickness of the coating layer formed finally on the web 12 is adjusted, it is preferable that coating operation be started after the relation between the coating amount and the recovering amount is adjusted so as to obtain a desired coating layer thickness by the adjustment of the rotational speeds of the driving motors for the supplying pump 38 and the suction pump 44, and fine adjustment of the coating layer thickness, in which only the relation between the coating amount and the recovering amount does not suffice, be made by the slit clearance adjusting device 15. In this case, the slit clearance adjusting device 15, which comprises the yoke 60 provided on the outside wall of the coating head 16, the urging screw 62, the supporting point screw 64, and the fixing screw 66, which are installed to the yoke 60, can easily make adjustment of slip clearance of the slits 30, 32 even during the coating operation.

Also, the slit clearance in the web width direction of at least one of the coating slit 30 and the recovering slit 32 is adjusted by three slit clearance adjusting devices 15 arranged in the widthwise direction of the web 12, by which the coating amount distribution and the scraping-off amount distribution in the web width direction can be adjusted. Thereby, the coating thickness distribution in the web width direction of the coating layer finally formed on the web 12 can be corrected.

Thus, in coating with two slits of the coating slit 30 and the recovering slit 32, by optimizing the slit clearances of the coating slit 30 and the recovering slit 32, a coating layer with a very small and even thickness can be obtained. Thereupon, the coating apparatus 10 in accordance with the present invention is suitable as a coating apparatus for obtaining an even and very thin magnetic layer required in manufacturing magnetic recording media, and is especially suitable for a very thin coat in which the wet thickness of magnetic coating liquid applied to the web 12 is 2 μm or smaller.

EXAMPLES

FIGS. 8(*a*) and 8(*b*) show the result of a test in which a scraping-off type coating apparatus shown in FIG. 1 was used, and the coating thickness distribution in the web width direction of the coating layer finally formed on the web was corrected by adjusting the slit clearance in the web width direction of the recovering slit by using the slit clearance adjusting device. As a material for the lip surface, WC—Co alloy with a particle diameter of main component of 1 μm was used.

Figure 9:
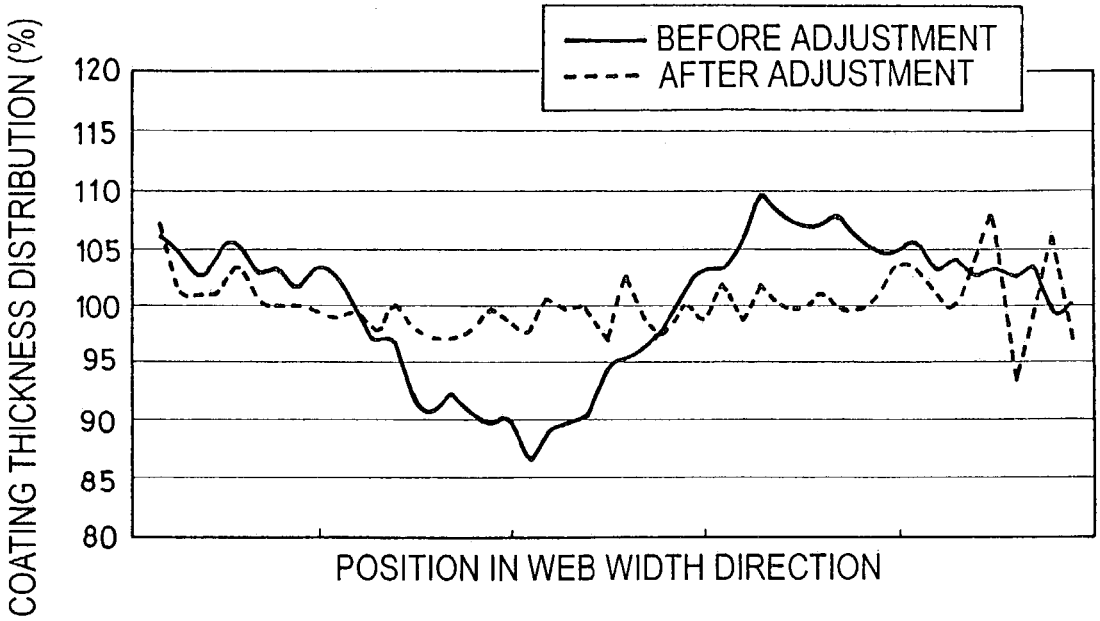
FIGS. 9(*a*) and 9(*b*) are graphs showing coat thickness distribution and clearance distribution in the web width direction before and after a coating slit is adjusted by a slit clearance adjusting device.
Figure 9:
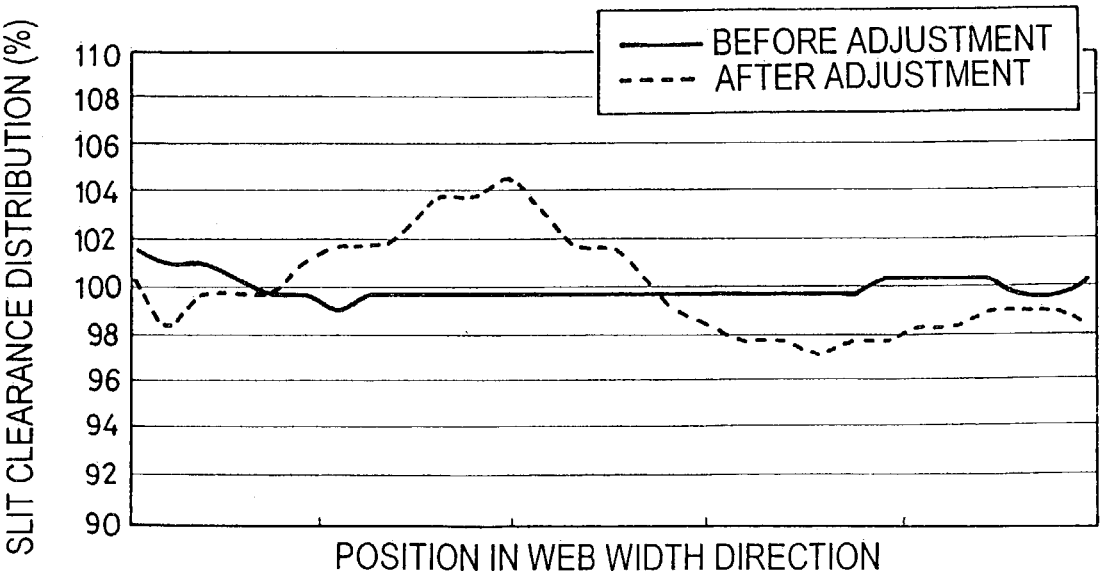

FIGS. 9(*a*) and 9(*b*) show the result of a test in which a scraping-off type coating apparatus shown in FIG. 1 was used, and the coating thickness distribution in the web width direction of the coating layer finally formed on the web was corrected by adjusting the slit clearance in the web width direction of the coating slit by using the slit clearance adjusting device.

The composition of the coating liquid subjected to the test was as given in Table 1, and the coating conditions were as given in Table 2. The thickness of the coating layer formed on the web was set at 2 μm in wet thickness.

TABLE 1

| Composition of coating liquid | Part by weight |
|---|---|
| Co substituted barium ferrite (BET specific surface area 35 $m^2/g$, average particle diameter 0.06 μm, plate ratio 5) | 35 |
| Vinyl chloride copolymer (polymerization degree 300) | 9 |
| $CrO_2$ (average particle diameter 0.3 μm) | 7 |
| Polyester polyurethane resin (average molecular weight 35000) | 10 |
| Carbon black (average particle diameter 30 μm) | 5 |

TABLE 1-continued

| Composition of coating liquid | Part by weight |
|---|---|
| Toluene | 36 |
| Cyclohexane | 36 |

After a coating liquid having the composition given in Table 1 was kneaded and dispersed in a prescribed manner, an organic solvent was added appropriately and mixed homogeneously, and the obtained coating liquid was used for the test. Although a magnetic coating liquid was used in this example, the type of coating liquid is not limited to this type.

TABLE 2

| Coating condition | Setting |
|---|---|
| Shape of back lip surface | Flat surface |
| Shape of doctor lip surface | Radius of curvature 10 mm |
| Shape of recovering lip surface | Radius of curvature 2 to 8 mm |
| Web | 30 μm thick polyethylene |
| Coating speed | 100 m/min |
| Coating width | 0.3 m |
| Delivery of supplying pump | 300 $cm^3$/min |
| Wet thickness of coating layer | 2 μm |

Test 1: Adjustment of Recovering Slit

In test 1, the coating liquid was applied to the web by using the coating apparatus in a state in which the recovering slit is not adjusted by three slit clearance adjusting devices, and the coating thickness distribution (%) in the web width direction of the sample before adjustment and the slit clearance distribution (%) in the web width direction of the recovering slit at this time were measured. The measured coating thickness distribution (%) is shown by a solid line in FIG. 8(*a*), and the slit clearance distribution (%) is shown by a solid line in FIG. 8(*b*).

Next, the slit clearance distribution in the web width direction of the recovering slit was individually adjusted by the three slit clearance adjusting devices so as to correct the coating thickness distribution shown by the solid line in FIG. 8(*a*), and then the coating liquid was applied again to the web by using the coating apparatus having been adjusted. The slit clearance distribution (%) after adjustment is shown by a broken line in FIG. 8(*b*), and the coating thickness distribution (%) after adjustment is shown by a broken line in FIG. 8(*b*).

As seen from this result, in coating with two slits of the coating slit and the recovering slit, by adjusting the clearance distribution in the web width direction of the recovering slit by using the slit clearance adjusting devices, the coating thickness distribution in the web width direction of the coating layer formed on the web can be adjusted with high accuracy.

Test 2: Adjustment of Coating Slit

In test 2, the coating liquid was applied to the web by using the coating apparatus in a state in which the coating slit is not adjusted by three slit clearance adjusting devices, and the coating thickness distribution (%) in the web width direction of the sample before adjustment and the slit clearance distribution (%) in the web width direction of the coating slit at this time were measured. The measured coating thickness distribution (%) is shown by a solid line in FIG. 9(*a*), and the slit clearance distribution (%) is shown by a solid line in FIG. 9(*b*).

Next, the slit clearance distribution in the web width direction of the coating slit was individually adjusted by the three slit clearance adjusting devices so as to correct the coating thickness distribution shown by the solid line in FIG. 9(*a*), and then the coating liquid was applied again to the web by using the coating apparatus having been adjusted. The slit clearance distribution (%) after adjustment is shown by a broken line in FIG. 9(*b*), and the coating thickness distribution (%) after adjustment is shown by a broken line in FIG. 9(*a*).

As seen from this result, in coating with two slits of the coating slit and the recovering slit, by adjusting the clearance distribution in the web width direction of the coating slit by using the slit clearance adjusting devices, the coating thickness distribution in the web width direction of the coating layer formed on the web can be adjusted with high accuracy.

Although either one of the recovering slit and the coating slit was adjusted in this example, both of these slits may be adjusted. Also, although explanation was given by taking a scraping-off type coating apparatus as an example, a similar result can be obtained in the case of the sucking-up type coating apparatus shown in FIG. 2. In this case, the amount of coating liquid sucked up by the suction pump was set at 240 $cm^3$/min.

According to the coating apparatus in accordance with the present invention, in coating with two slits of the coating slit and the recovering slit, by optimizing the slit clearance of the coating slit and the recovering slit, a coating layer with a very small and even thickness can be obtained.

Thereupon, the coating apparatus in accordance with the present invention is suitable as a coating apparatus for obtaining an even and very thin magnetic layer required in manufacturing magnetic recording media, and is especially suitable for a very thin coat in which the wet thickness of magnetic coating liquid applied to the web is 2 μm or smaller.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A coating apparatus in which in a state where a continuously running web is brought close to a lip surface at a tip of a coating head, a coating liquid sent into the coating head in excess of a desired amount is discharged through a coating slit and is applied to the web, and an excess of coating liquid applied to excess is scraped off with a recovering slit provided on a downstream side of the coating slit in a running direction of the web, wherein:

there is provided a first slit clearance adjusting device which adjusts a slit clearance of the coating slit in the running direction of the web and a second slit clearance adjusting device which adjusts a slit clearance of the recovering slit in the running direction of the web.

2. A coating apparatus in which in a state where a continuously running web is brought close to a lip surface at a tip of a coating head, a coating liquid sent into the coating head in excess of a desired amount is discharged through a coating slit and is applied to the web, and an excess of coating liquid applied to excess is sucked up with a sucking-up device through a recovering slit provided on a downstream side of the coating slit in a running direction of the web, wherein:

there is provided a first slit clearance adjusting device which adjusts a slit clearance of the coating slit in the running direction of the web and a second slit clearance adjusting device which adjusts a slit clearance of the recovering slit in the running direction of the web.

3. A coating apparatus in which in a state where a continuously running web is brought close to a lip surface at a tip of a coating head, a coating liquid sent into the coating head in excess of a desired amount is discharged through a coating slit and is applied to the web, and an excess of coating liquid applied to excess is scraped off with a recovering slit provided on a downstream side of the coating slit in a running direction of the web, wherein:

a first slit clearance adjusting device adjusts a clearance of the coating slit by increasing or decreasing the force applied to one of the walls of the coating slit and a second slit clearance adjusting device adjusts a clearance of the recovering slit by increasing or decreasing the force applied to one of the walls of the recovering slit.

* * * * *